US006364237B1

(12) United States Patent
Kagel

(10) Patent No.: US 6,364,237 B1
(45) Date of Patent: Apr. 2, 2002

(54) RETRACTABLE BADGEHOLDER WITH SPINNING DISPLAY

(75) Inventor: David Kagel, Calabasas, CA (US)

(73) Assignee: Perfect Promotional Products, Oxnard, CA (US)

( * ) Notice: Subject to any disclaimer, the term of this patent is extended or adjusted under 35 U.S.C. 154(b) by 0 days.

(21) Appl. No.: 09/595,124

(22) Filed: Jun. 16, 2000

(51) Int. Cl.[7] ..... B65H 75/48; A63F 1/18; G09F 11/04

(52) U.S. Cl. ..... 242/379; 242/371; 273/142 R; 40/495

(58) Field of Search ..... 242/379, 379.2, 242/371, 400; 273/142 R; 446/243, 247, 248, 249; 40/495; 33/761

(56) References Cited

U.S. PATENT DOCUMENTS

| | | | | | |
|---|---|---|---|---|---|
| 812,150 | A | | 2/1906 | McLean | |
| 1,443,194 | A | * | 1/1923 | Pichler | 242/379 |
| 1,942,006 | A | * | 1/1934 | Shikaly | 446/249 |
| 2,732,148 | A | * | 1/1956 | Lummis | 242/379 |
| 3,524,273 | A | | 8/1970 | Shore | |
| 3,968,670 | A | * | 7/1976 | Quenot | 242/379 |
| 4,028,843 | A | * | 6/1977 | Appel | 446/249 X |
| 4,555,235 | A | * | 11/1985 | Burroughs | 446/243 X |
| 4,953,809 | A | * | 9/1990 | Barrus | 242/379 |
| 5,815,873 | A | | 10/1998 | Jones | |
| 5,833,165 | A | * | 11/1998 | Paugh | 242/379.2 |
| 5,996,932 | A | | 12/1999 | Wang | |

* cited by examiner

*Primary Examiner*—William A. Rivera
(74) *Attorney, Agent, or Firm*—Lyon & Harr, LLP; Richard T. Lyon; Mark A. Watson

(57) ABSTRACT

A retractable badgeholder wherein a window in the front face of the case of the badgeholder is provided, through which a design, such as a pattern, inscription, or logo can be seen. When a retractable cord of this improved badgeholder is pulled out of the case it causes the design to rotate or spin. Likewise, when the cord is retracted back into the case of the badgeholder, the design spins. Thus, anyone observing the badgeholder will see the spinning design. It is believed this spinning design will be interesting to observers, thus lending special appeal to the improved badgeholder.

19 Claims, 2 Drawing Sheets

RETRACTABLE BADGEHOLDER WITH SPINNING DISPLAY

BACKGROUND

1. Technical Field

This invention relates to a retractable badgeholder, and more specifically to such a badgeholder incorporating a spinning display.

2. Background Art

A retractable badgeholder is a device having a case inside of which is a reel with a cord wrapped around it. The reel is configured such that the free end of the cord can be pulled, thereby rotating the reel, and when the end of the cord is released, the reel automatically rewinds the cord. The case typically has a clip on its backside for securing it to a shirt pocket, pants waistband, etc. of a wearer. The free end of the cord is attached to a bob which in turn is attached to a badge holding strap.

The purpose of the retractable badgeholder is to allow a wearer to attach a badge to the badge holding strap and to clip the badgeholder to his or her clothing. The badge is usually of the type that contains identifying information concerning the wearer, and which may be readable by a conventional electronic sensing device. In this latter case, the badge typically includes an electronic "chip" or a magnetic strip that has been encoded with certain identification information that is read by the sensor. Typically, the wearer would either present the badge to someone who would "scan" it using a handheld sensing device for example, or the wearer could be required to slide or "swipe" the badge through a stationary sensing device. In this way, the badge can be used as an electronic ID for security purposes, or to allow an employee to time in or out, etc.

A design or logo is often imprinted on the front side of the case where it is visible to anyone looking at the badgeholder. These designs and logos are intended to make what could otherwise be an unattractive and detracting device into an interesting clothing accessory. Further, the logos often identify the company for which an employee wearing the badgeholder works, or a club or organization to which the wearer belongs. Thus, the logos provide further identifying information about the wearer, and in some circumstances free publicity for the company or organization.

SUMMARY

The present invention is directed toward an improvement to the existing retractable badgeholders described above. This improvement involves creating a window in the front face of the case of the badgeholder, through which a design, such as a pattern, inscription, or logo can be seen. When the cord of this improved badgeholder is pulled out of the case it causes the design to rotate or spin. Likewise, when the cord is retracted back into the case of the badgeholder, the design spins. Thus, anyone observing the badgeholder will see the spinning design. It is believed this spinning design will be interesting to observers, thus lending special appeal to the improved badgeholder.

More specifically, the retractable badgeholder according to the present invention includes a case having an viewing port on its front side through which a rotating display plate disposed inside the case can be seen. This viewing port can be open to the outside, or if desired, the viewing port could be formed using a transparent window. The display plate has a design on its exterior facing side which is visible from the outside through the viewing port. The badgeholder also includes a cord, which in it normal mode is fully retracted within the case with the exception of a free end that extends outside the case through a hole in its periphery. This cord is attached at its free end to a badge securing unit that is capable of releasable attaching a badge to the badgeholder. The cord can be manually extended from the case by a user, so that a badge attached to the badgeholder can be presented for inspection or electronic sensing, as described previously. The cord is under tension from within the case such that when extended and released, or when the free end of the cord is guided back toward the case by the user, the tension on the cord causes it to retract back into the case. Whenever, the cord is extended from or retracted into the case of the badgeholder, the aforementioned display plate rotates within the case, thus proving the aforementioned interesting spinning design.

The design on the display plate can be incorporated in a number of ways. For example, the design could be formed into the exterior facing surface of the plate, such as by embossing. The design could also be formed over the surface of the exterior facing side of the display plate. This could be accomplished using paint or ink. Alternately, the display plate could be made using a label and a backing plate. In this latter case, the design would be on a front side of the label which acts as the exterior facing side of the display plate. This label is attached to the backing plate by its back side to complete the display plate.

The badge securing unit of the badgeholder preferably includes a bob that is connected to the free end of the cord. This bob is larger than the hole in the periphery of the case though which the cord extends so as to prevent the free end of the cord from retracting completely into the case. In addition, the badge securing unit includes a conventional badge clip that is connected to the bob. A badge can be releasable attached to the badge clip. Further, the badgeholder includes a releasable attachment clip that is connected to a backside of the case. This clip is capable of releasably attaching the case to the clothing of a user. In this way, a badge attached to the badge clip would hang down from the badgeholder when the cord is in its fully retracted mode so that it could be place in plain view of others in the vicinity of the person wearing the badgeholder. It is noted that the tension applied to the cord in it fully retracted mode is sufficient to hold the bob against the periphery of the case when a badge is attached to the badge clip. This ensures that the weight of the badge alone does not cause the cord to extend. It is also noted that the length of the cord is made such that the user can extend the cord a sufficient distance to present the badge for inspection or sensing without pulling the badgeholder off of their clothing.

The case of the badgeholder can have any desired shape. For example, the case when viewed from its front side can have a shape approximating a circle, ellipse, or some form of a polygon (e.g., a triangle, square, rectangle, hexagon, etc.). The viewing port can also take on any desired shape, and need not be the same as the case. Likewise, the display plate can have any desired shape, although a circular disc shape is preferred to facilitate its rotation within the case.

In addition to the just described benefits, other objectives and advantages of the present invention will become apparent from the detailed description which follows hereinafter when taken in conjunction with the drawing figures which accompany it.

DESCRIPTION OF THE DRAWINGS

The specific features, aspects, and advantages of the present invention will become better understood with regard to the following description, appended claims, and accompanying drawings where:

DETAILED DESCRIPTION OF THE PREFERRED EMBODIMENTS

In the following description of the preferred embodiments of the present invention, reference is made to the accompanying drawings which form a part hereof, and in which is shown by way of illustration specific embodiments in which the invention may be practiced. It is understood that other embodiments may be utilized and structural changes may be made without departing from the scope of the present invention.

Figure 1A:
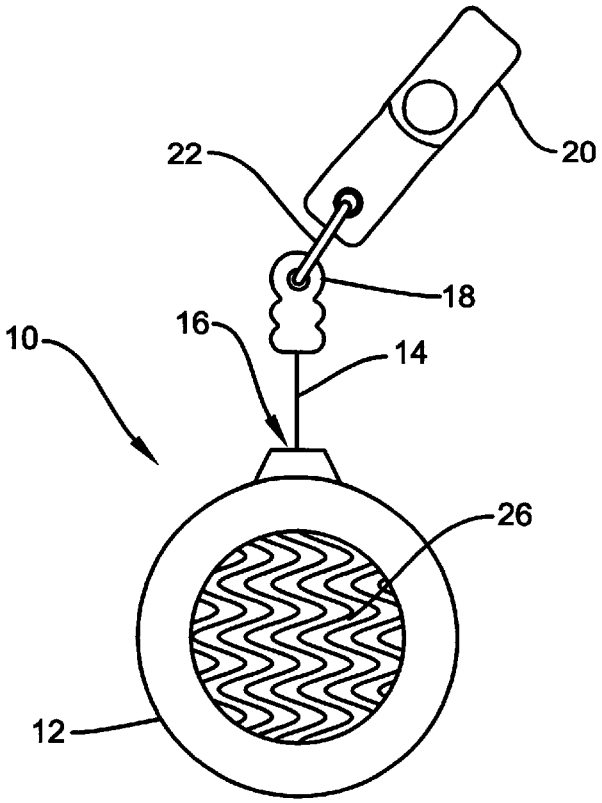
FIG. 1A is a front view of a retractable badgeholder according to the present invention.
Figure 1B:
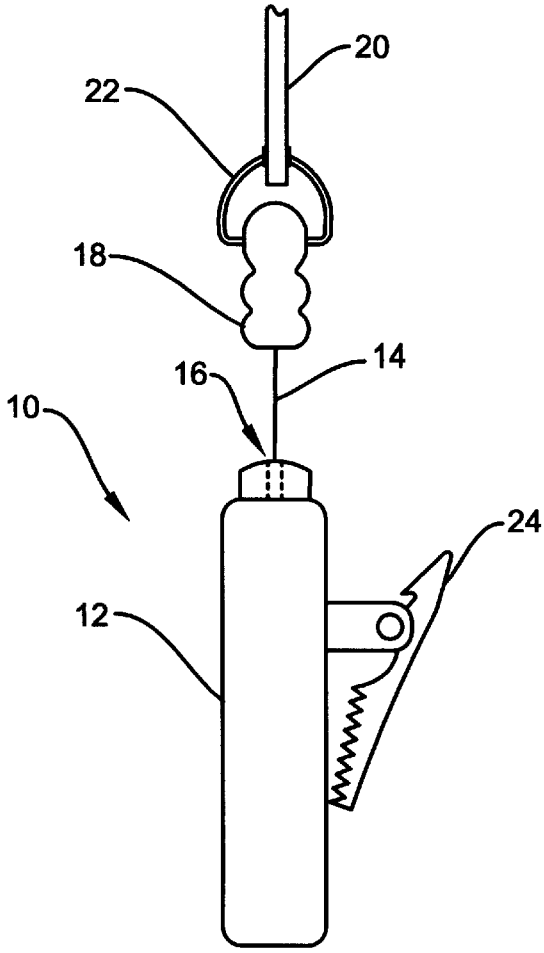
FIG. 1B is a side view of a retractable badgeholder according to the present invention.

FIGS. 1A and 1B depict a retractable badgeholder 10 embodying the present invention. Generally, the badgeholder 10 is a device having a case 12 inside of which is an extendable and retractable cord 14. The case 12, is shown in FIG. 1A as having a circular shape. However, the case 12 can have any shape desired, such as an elliptical shape (e.g., oval) or polygonal shape (e.g., triangular, square, rectangular, hexagonal, etc.), as desired. The cord 14 passes from the interior of the case 12 to the exterior through a port 16 located along the peripheral edge of the case. The end of the cord 14 extending through to the exterior side of the case 12 is attached to a bob 18, which is physically larger that the port. As will be explained later in this description, the cord 14 is under tension from within the case 12 such that it tends to want to retract into the case. In a fully retracted mode, the bob 18 is pulled by the tensioned cord 14 against the exterior of the case 12. This prevents the cord 14 from retracting completely into the case. The bob 18 is connected a conventional badge clip 20 via any appropriate connector, such as the connecting ring 22 shown in FIGS. 1A and 1B. A badge (not shown), such as those mentioned previously is attached to the badge clip 20 when the retractable badgeholder 10 is in use. The badgeholder can be clipped to the wearer via any appropriate releasable device, such as the clip 24 shown attached to the backside of the case 12 in FIG. 1B.

The badgeholder's normal mode is the aforementioned retracted mode. In the retracted mode, the badge hangs down from the badgeholder, which is typically clipped to the clothing (e.g., shirt pocket, pants waistband, jacket lapel, etc.) of a person wearing the badge via clip 24. When the badge is to be presented or "swiped" as described previously, the wearer pulls on the badge or the badge clip 20 away from the case 12 of the badgeholder. The portion of the cord 14 contained within the case 12 is played out as the wearer pulls. It is noted that the length of the cord 14 is made long enough so that the badge can be readily presented or "swiped" by a user without the cord being fully extended from the case. For example, in tested embodiments of the present invention, the cord was made approximately 2–3 feet long. When the wearer releases the badge, or guides it back toward the badgeholder 10, the tension placed on the cord 14 pulls the cord back into the case 12, until the bob 18 buts against the periphery of the case. In this way the badge can be extended and retracted as needed.

A display 26, such as a design, pattern, inscription, or logo (collectively referred to hereinafter as a design), is visible from the front side of the badgeholder's case 12. When the cord 14 is pulled out of the case 12 or retracted back into the case, the display 26 rotates thereby providing an interesting visual presentation to anyone looking at the badgeholder 10. In other words, someone observing the badgeholder will see the spinning design. This spinning design will draw the attention of an observer who may not have otherwise been focused on it. It is believed that purchasers of retractable badgeholders will find the spinning design more interesting than the conventional models.

Having generally described the exterior components and operation of a badgeholder 10 embodying the present invention, an internal mechanism for achieving the automatic retraction of the cord 14 and the spinning of the display 26 will now be presented. It is noted that this internal mechanism is only an example of one preferred embodiment and it is not intended that the present invention be limited to just this embodiment. Rather, any mechanism that causes the display 26 to spin when the cord 14 is extended or retracted could be substituted. The important aspect is that the display rotates, not particularly how it is made to rotate.

Figure 2A:
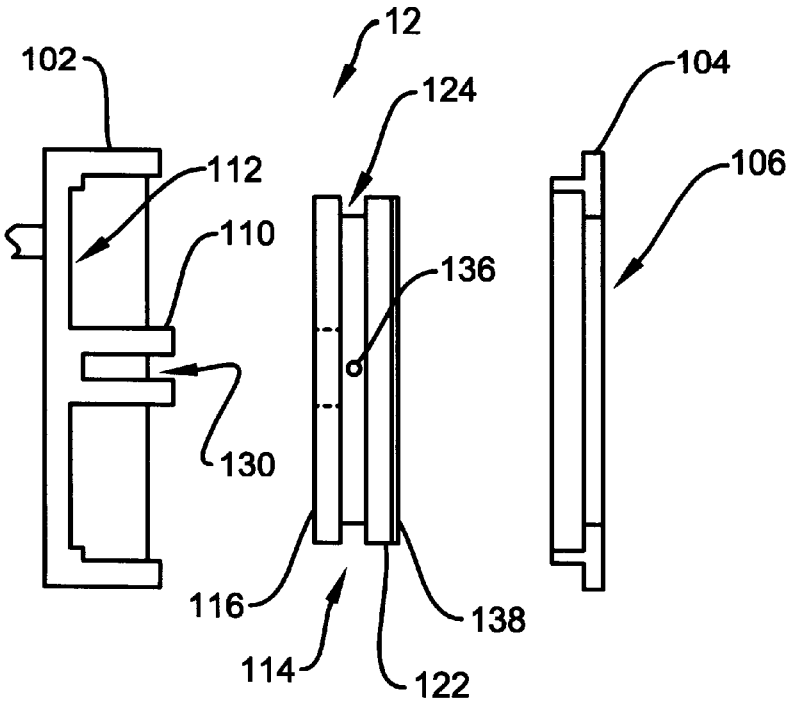
FIG. 2A is partially cross-sectional, exploded, side view of the components making up the case of the retractable badgeholder of FIGS. 1A and 1B.
Figure 2B:
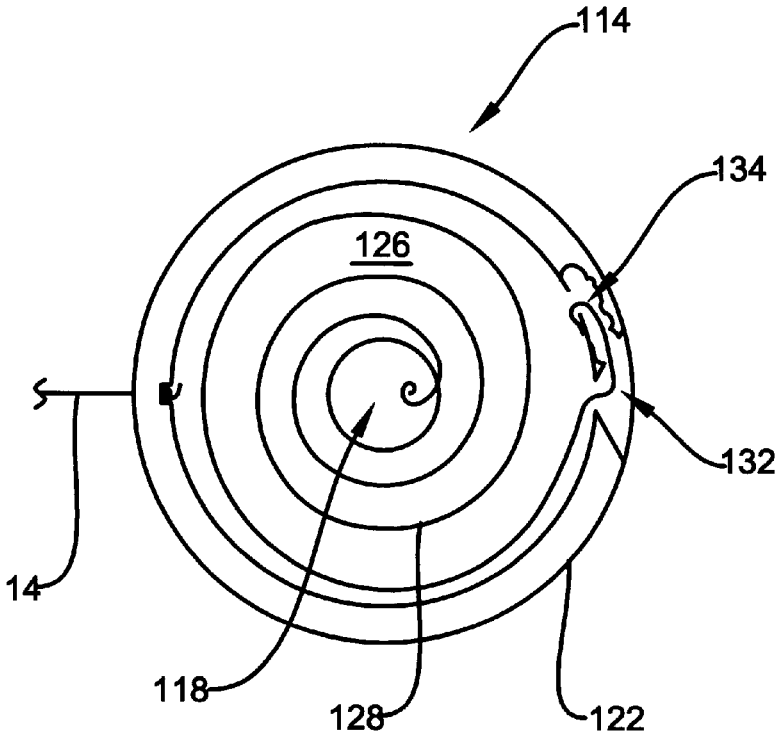
FIG. 2B is a front view of a reel of the retractable badgeholder of FIGS. 1A and 1B, including a wind-up spring disposed in the central cavity of the reel.

Referring to FIGS. 2A and 2B, the case 12 includes a back piece 102, and a cover 104, each of which is can be formed from molded plastic, metal or any other appropriate casing material. The cover 104 has an opening 106 through which the display 26 can be seen. Optionally, the opening 106 can be bridged with a transparent window (not shown) to prevent contaminants from getting into the interior of the case 12. It is noted that while the opening 106 in the cover 104 is shown as being circular, it can have any desired shape. Further, the shape of the opening 106 does not necessarily have to be the same as the case 12.

The back piece 102 of the cover has a centrally-located slotted post 110 that protrudes up perpendicularly from its inner wall 112. A reel 114 is disposed within the interior space of the case 12. The reel 114 has a disc shaped backwall 116 with a central hole 118, which has a diameter slightly exceeding that of the slotted post 110. A ring-shaped projection 120 extends out from the interior-facing side of the backwall 116 slightly inward of its peripheral edge. An annular wall 122 extends out radially from the edge of the ring-shaped projection 120 opposite its attachment to the backwall 116. This annular wall 122 preferably extends out the same distance as the backwall 116. The foregoing structure of the reel 114 defines a groove 124 having sidewalls formed by the peripheral portion of the backwall 116 and the annular wall 122, and a floor formed by the ring-shaped projection 120. In addition, the ring-shaped projection 120 and the inner portion of the backwall 116 define a central cavity 126 of the spool. The reel 114 is positioned onto the slotted post 110 such that the slotted post extends through the central hole 118 of the spool's backwall and into its central cavity 126. Preferably, the slotted post 110 extends out to a point approximately flush with the mouth of the central cavity 126. The reel 114 is free to rotate about the slotted post 110 within the interior space of the case 12 owing to the diameter of the slotted post being slightly smaller than that of the central hole 118 of the spool's backwall.

A wind-up spring 128 is disposed within the central cavity 126 of the spool. The spring 128 can be made of any resilient material, such as spring steel. The inner end of the spring 128 is secured in place by threading it through and around the slot 130 in the slotted post. The spring 128 forms a convoluted winding within the central cavity 126, with the outer end of the spring extending out of the cavity through a gap 132 in the ring-shaped projection 120. The outer end of the spring is threaded through a slot 134 formed through the ring-shaped projection 120 from the groove side of the projection back into the central cavity 126 so as to secure the outer end of the spring to the reel 114. Thus, the inner end the spring 128 is secured to the back piece 102 via the slotted post 110, and the outer end of the spring is secured to the reel 114. The ring-shaped projection 120 also has a through-hole 136 through which one end of the cord 14 is threaded from the groove side of the projection. This end of the cord 14 is secured to the reel 114 within the central cavity 126.

In its retracted mode, the cord 14 is completely wound around the reel 114 and contained within its groove 124, with the exception of a short length at its free end that extends through the port in the case and is attached to the aforementioned bob. As stated previously, the cord 14 is under tension and only the bob keeps it from fully retracting into the case. This tension on the cord 14 is created by the spring 128. Essentially, a wind-up spring wants to uncoil. Because one end of the spring 128 is anchored to the case 12 via the slotted post 110 of the back piece and the other end is attached to the reel 114, and coiled within the central cavity 126 of the reel, the result is a rotational force on the reel about the slotted post. Depending on how the spring 128 is attached between the slotted post 110 and the reel 114, the direction of the rotational force may be either clockwise or counterclockwise. Either direction is acceptable, as long as the cord 14 is wrapped around the reel 114 in the direction opposite of the rotational force on the reel. In this way the rotational force tends to want to wrap the cord 14 further onto the reel 114. In the aforementioned fully retracted mode, the spring 128 is wound tight enough to ensure the weight of any attached badge will not be sufficient to overcome the resulting pre-tension. Thus, the badge is held in place close to the badgeholder. As the cord 14 is pulled out, as when the user is presenting or "swiping" the badge, the reel 114 rotates in relation to the case 12 a direction that causes the spring 128 to wind even more tightly. Accordingly, when the user releases the extended badge or guides it back toward the badgeholder, the spring tension causes the reel 114 to rotate in the opposite direction so as to take up the cord 14 into the groove 124 of the reel until the bob butts against the peripheral edge of the case. It is noted that the spring 128 is designed via conventional methods so that when the cord 14 is fully extended from the case 12 of the badgeholder, the tension is not so great that a user can not easily hold the badge in place without it being pulled free from the user's hand.

The aforementioned display preferably takes the form of a disc 138 that is attached to the side of the reel 114 opposite its backwall 116. The interior facing side of this disc 138 is attached via any appropriate method (e.g., adhesives, mechanical fasteners, etc.) to the reel 114, preferably at its interface with the annular wall 122, and optionally at its interface with the distal end of the slotted post 110. Thus, the disc 138 encloses the central cavity 126 of the reel. The exterior facing side of the disc 138 is visible through the opening 106 of the cover, or through the optional transparent window, as the case may be. The aforementioned design is disposed on the exterior facing side of the disc 138, where persons viewing the badgeholder can see it. This can be accomplished in a variety of ways. For example, the design can be formed into the surface of the disc, such as by embossing, or it can be formed on the surface of the disc, such as by the use of paints, inks, etc. Or alternately, a label or sticker having the design formed thereon could be attach to the exterior facing side of the disc. Since the disc 138 displaying the design is attached to the reel 114, it will rotate with the reel when the cord 14 is extended from or retracted into the case 12 of the badgeholder, thereby providing the interesting display discussed previously. It is noted that if a transparent window is employed, the window itself could include design elements that complement or complete the design on the disc 138. It is further noted that while it is preferred that the display take the form of a disc, other shapes are feasible as long as they do not interfere with the rotation of the reel 114 within the case 12.

While the invention has been described in detail by reference to the preferred embodiment described above, it is understood that variations and modifications thereof may be made without departing from the true spirit and scope of the invention. For example, while the present invention has been described in the context of a badgeholder, the spinning display could be adapted to other devices as well. For example, keys are often carried by persons using a retractable key chain. In such a device, the keys are held close to the body of the key chain, which is typically attached to the clothing of the user. The keys are attached to a key ring, which is in turn attached to an extendable and retractable cord, similar to the one used in connection with the present invention. This retractable keychain could be modified in accordance with the present invention to include a display port and design visible through the port which would rotate when the cord is extended or retracted.

Wherefore, what is claimed is:

1. A retractable holding apparatus, comprising:

a case having a viewing port on a front side thereof;

a rotatable display plate disposed within the case and having an exterior facing side which is at least partially visible from the outside through said viewing port; and a securing unit which is capable of attachment to an article which is to be held by the holding apparatus, said securing unit being connected to an extendable and automatically retracting cord housed inside said case; and wherein said display plate rotates whenever the cord is extended from the case or retracted back into the case.

2. The apparatus of claim 1, wherein the article which is held by the holding apparatus comprises a badge.

3. The apparatus of claim 1, wherein the article which is held by the holding apparatus comprises at least one key.

4. The apparatus of claim 1, further comprising a releasable attachment device connected to a backside of said case which is capable of releasably attaching the retractable holding apparatus to the clothing of a user.

5. The apparatus of claim 1, wherein the rotatable display plate exhibits a design on its exterior facing side which is visible from the outside through said viewing port.

6. The apparatus of claim 5, wherein said design is embossed into the exterior facing side of the display plate.

7. The apparatus of claim 5, wherein said design is formed over the surface of the exterior facing side of the display plate.

8. The apparatus of claim 7, wherein the design formed over the surface of the exterior facing side of the display plate comprises one of (i) paint, and (ii) ink.

9. The apparatus of claim 5, wherein said display plate comprises a label and a backing plate, and wherein said design is disposed on a front side of the label which acts as the exterior facing side of the display plate, and wherein the label is attached to the backing plate by its back side.

10. The apparatus of claim 1, wherein said viewing port comprises a transparent window.

11. The apparatus of claim 1, wherein the case, when viewed from its front side, comprises a shape approximating one of a (i) circle, (ii) ellipse, and (iii) polygon.

12. The apparatus of claim 1, wherein the viewing port, when viewed from the front side of the case, comprises a shape approximating one of a (i) circle, (ii) ellipse, and (iii) polygon.

13. The apparatus of claim 1, wherein the exterior facing side of said display plate comprises a shape approximating one of a (i) circle, (ii) ellipse, and (iii) polygon.

14. The apparatus of claim 1, wherein the display plate is disc shaped.

15. A retractable badgeholder, comprising:

a case having a viewing port on a front side thereof;

a rotatable display plate disposed within the case and having a design on an exterior face which is visible from the outside through said viewing port;

a cord which is normally retracted within the case with the exception of a free end thereof which extends outside the case through a hole in the periphery of the case, said cord being manually extendable from the case by a user and under tension from within the case such that when extended from the case and released, or when the free end of the cord guided back to the case by the user, said tension on the cord causes it to retract back into the case; and a badge securing unit which is capable of attachment to a badge and which is connected to the free end of said cord, and wherein;

said display plate rotates whenever the cord is extended from or retracted back into the case.

16. The badgeholder of claim 15, wherein the badge securing unit comprises:

a bob which is connected to said free end of the cord, said bob being larger than said hole in the periphery of the case at its point of connection to the free end of the cord so as to prevent the free end of the cord from retracting into the case; and a badge clip which is connected to the bob and releasable attachable to said badge.

17. The badgeholder of claim 16, wherein the tension applied to the cord in a fully retracted mode is sufficient to hold the bob against the periphery of the case when a badge is attached to the badge clip.

18. The badgeholder of claim 17, further comprising a releasable attachment clip connected to a backside of said case which is capable of releasably attaching the case to the clothing of a user such that a badge attached to the badge clip hangs down from the badgeholder when the cord is in its fully retracted mode.

19. The badgeholder of claim 15, wherein the length of the cord is such that the user can extend the cord a sufficient distance to present a badge attached to the badge securing unit for inspection.

* * * * *